US009417585B2

(12) United States Patent
Sato et al.

(10) Patent No.: US 9,417,585 B2
(45) Date of Patent: Aug. 16, 2016

(54) IMAGE FORMING APPARATUS

(71) Applicant: FUJI XEROX CO., LTD., Tokyo (JP)

(72) Inventors: Kunihiko Sato, Kanagawa (JP); Kosuke Yamada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 97 days.

(21) Appl. No.: 14/285,827

(22) Filed: May 23, 2014

(65) Prior Publication Data

US 2015/0090826 A1 Apr. 2, 2015

(30) Foreign Application Priority Data

Oct. 2, 2013 (JP) ..... 2013-207240

(51) Int. Cl.
*G03G 15/01* (2006.01)
*G03G 15/00* (2006.01)
*G03G 21/16* (2006.01)

(52) U.S. Cl.
CPC ..... *G03G 15/6529* (2013.01); *G03G 15/0178* (2013.01); *G03G 15/652* (2013.01); *G03G 21/1604* (2013.01); *G03G 2215/00021* (2013.01)

(58) Field of Classification Search
CPC ..... G03G 15/6529
USPC ..... 399/300
See application file for complete search history.

(56) References Cited

U.S. PATENT DOCUMENTS 6,212,357 B1 * 4/2001 Boehmer ..... G03G 15/00 399/299
6,246,856 B1 * 6/2001 Kopp ..... G03G 15/231 399/299
6,259,884 B1 * 7/2001 Oberhoffner ..... G03G 15/238 101/211
7,672,634 B2 * 3/2010 Lofthus ..... G03G 15/2003 399/341
7,865,125 B2 * 1/2011 Moore ..... G03G 15/652 271/9.1
8,253,958 B2 * 8/2012 Brougham ..... G06Q 10/06 358/1.13
2004/0105711 A1 * 6/2004 Fuchs ..... B41F 13/03 399/384
2006/0039729 A1 * 2/2006 Mandel ..... G03G 15/238 399/381
2006/0114313 A1 * 6/2006 Moore ..... G03G 15/5062 347/262
2007/0140711 A1 * 6/2007 Anderson ..... G03G 15/55 399/16
2009/0146371 A1 * 6/2009 Mandel ..... B65H 29/60 271/287
2010/0264574 A1 * 10/2010 Tyson ..... B65H 3/44 271/3.14
2010/0270728 A1 * 10/2010 Hoover ..... B41J 3/54 271/9.01
2012/0093559 A1 * 4/2012 Vanheuverzwijn ..... B41J 3/60 400/642

FOREIGN PATENT DOCUMENTS

JP 2012-116153 A 6/2012

* cited by examiner

*Primary Examiner* — Rodney Fuller
(74) *Attorney, Agent, or Firm* — Sughrue Mion, PLLC

(57) ABSTRACT

Provided is an image forming apparatus including plural image forming portions that form an image on a recording medium, and a transport unit that transports the recording medium to at least one image forming portion selected among the plural image forming portions, wherein the transport unit includes plural transport paths that are different at least in an image forming portion, to which the recording medium is transported, among the plural image forming portions, and in an order of the recording medium transported to each image forming portion constituting the image forming portion to which the recording medium is transported.

18 Claims, 14 Drawing Sheets

IMAGE FORMING APPARATUS

CROSS-REFERENCE TO RELATED APPLICATIONS

This application is based on and claims priority under 35 USC 119 from Japanese Patent Application No. 2013-207240 filed Oct. 2, 2013.

BACKGROUND

Technical Field

The present invention relates to an image forming apparatus.

SUMMARY

According to an aspect of the invention, there is provided an image forming apparatus including:

plural image forming portions that form an image on a recording medium; and a transport unit that transports the recording medium to at least one image forming portion selected among the plural image forming portions, wherein the transport unit includes plural transport paths that are different at least in an image forming portion, to which the recording medium is transported, among the plural image forming portions, and in an order of the recording medium transported to each image forming portion constituting the image forming portion to which the recording medium is transported.

BRIEF DESCRIPTION OF THE DRAWINGS

Exemplary embodiments of the present invention will be described in detail based on the following figures, wherein.

DETAILED DESCRIPTION

Next, exemplary embodiments of the present invention will be described with reference to the drawings.

Figure 1:
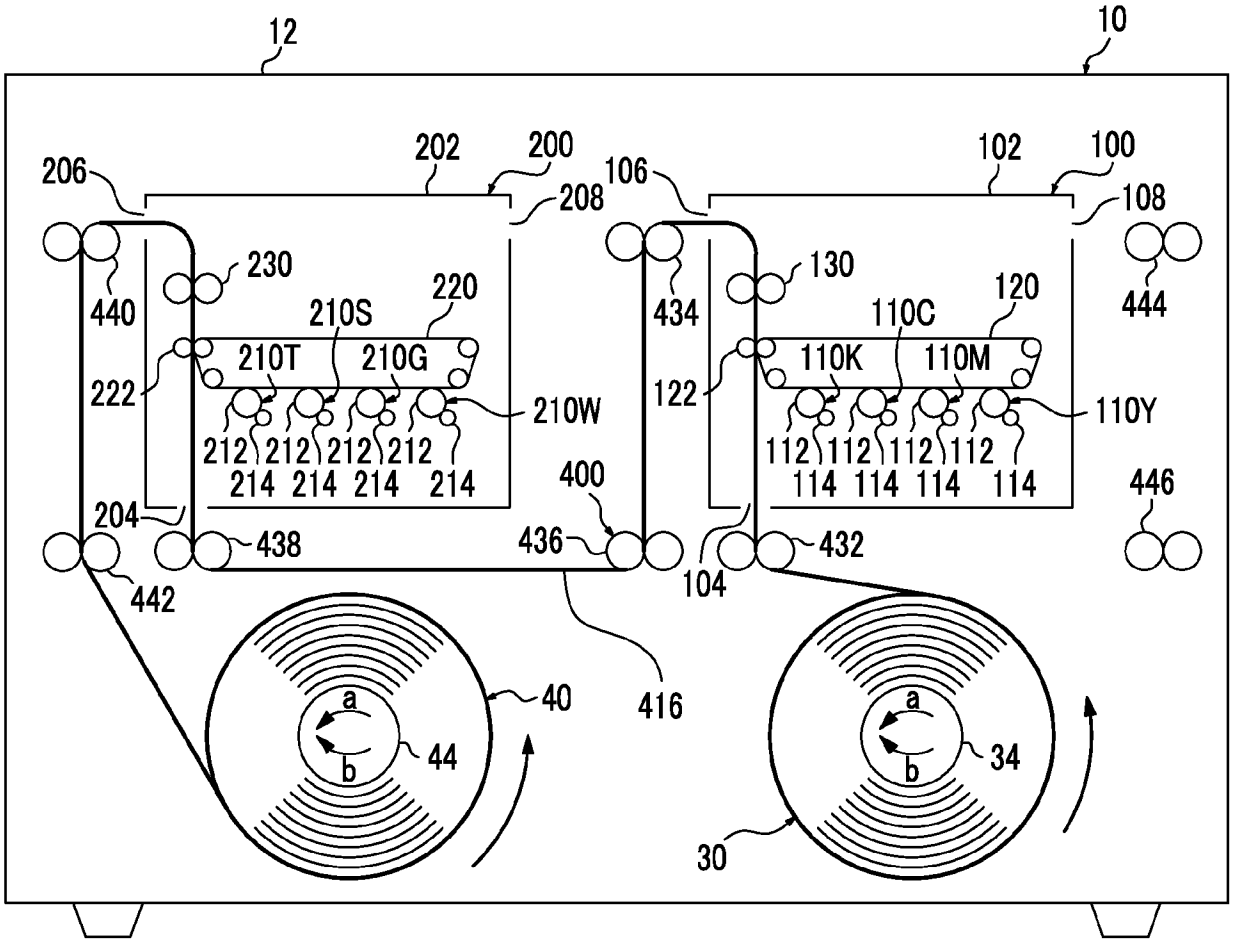
FIG. 1 is a diagram showing an image forming apparatus according to a first exemplary embodiment of the present invention.

FIG. 1 shows an image forming apparatus 10 according to a first exemplary embodiment of the present invention. As shown in FIG. 1, the image forming apparatus 10 includes an image forming apparatus body 12, and in the image forming apparatus body 12, a first unwinding and rewinding device 30, a second unwinding and rewinding device 40, a first image forming portion 100, a second image forming portion 200, and a transport mechanism 400 are provided. The image forming apparatus 10 forms an image on a sheet that is used as a recording medium, and for example, forms an image on a web that is used as a recording medium continuously wound in a longitudinal direction, and the recording medium on which the image is formed is rewound to be wound in the longitudinal direction.

The first unwinding and rewinding device 30 may be used as an unwinder that supplies the sheet, may be used as a rewinder that rewinds the sheet on which the image is formed, and includes a rotating shaft 34 that is selected to move either in a direction shown by arrow a in FIG. 1 or a direction shown by arrow b in FIG. 1 and may be rotated. When the first unwinding and rewinding device 30 is used as the unwinder, in a case where the sheet is supplied (refer to FIGS. 2, 3, and 4) so that the image is formed on a front surface (outer surface) of the wound sheet, the rotating shaft 34 is inserted into a hollow portion of the sheet wound in a roll shape and the sheet is mounted on the rotating shaft 34, and the sheet is fed to the transport mechanism 400 by rotating the rotating shaft 34 in the arrow a direction. On the other hand, when the first unwinding and rewinding device 30 is used as the rewinder, in a case where the sheet is rewound (refer to FIG. 5) so that the surface on which the image is formed is toward the outer side, a tip portion of the sheet is fixed to the rotating shaft 34, and the sheet is rewound to be wound around the rotating shaft 34 by rotating the rotating shaft 34 in the arrow a direction.

When the first unwinding and rewinding device 30 is used as the unwinder and when the first unwinding and rewinding device 30 is used as the rewinder, the directions, in which the sheets are wound around the rotating shaft 34, become directions opposite to each other. Moreover, when the first unwinding and rewinding device 30 is used as the unwinder, the first unwinding and rewinding device 30 may supply (refer to FIG. 11) the sheet so that the image is formed on the rear surface of the wound sheet as described below, instead of supplying the sheet to form the image on the front surface of the wound sheet. Moreover, when the first unwinding and rewinding device 30 is used as the rewinder, the first unwinding and rewinding device 30 may rewind (refer to FIG. 12) the sheet so that the surface on which the image is formed is toward the inner side as described below, instead of rewinding the sheet so that the surface on which the image is formed is toward the outer side in the state where the sheet is wound.

Moreover, the first unwinding and rewinding device 30 is disposed so that an upper end portion of the first unwinding and rewinding device 30 is positioned below a lower end portion of the first image forming portion 100 and a lower end portion of the second image forming portion 200 in the direction of gravity. Moreover, at least a portion of the first unwinding and rewinding device 30 is disposed below the first image forming portion 100 in the direction of gravity to overlap with the first image forming portion 100 in the direction of gravity.

Similar to the first unwinding and rewinding device 30, the second unwinding and rewinding device 40 may be used as an unwinder that supplies the sheet, may be used as a rewinder that rewinds the sheet on which the image is formed, and includes a rotating shaft 44 that is selected to move either in a direction shown by the arrow a in FIG. 1 or a direction shown by the arrow b in FIG. 1 and may be rotated. When the second unwinding and rewinding device 40 is used as the unwinder, in a case where the sheet is supplied (refer to FIG. 5) so that the image is formed on the front surface (outer surface) of the wound sheet, the rotating shaft 44 is inserted into a hollow portion of the sheet wound in a roll shape and the sheet is mounted on the rotating shaft 44, and the sheet is fed to the transport mechanism 400 by rotating the rotating shaft 44 in the arrow a direction. On the other hand, when the second unwinding and rewinding device 40 is used as the rewinder, in a case where the sheet is rewound (refer to FIGS. 2, 3, and 4) so that the surface on which the image is formed is toward the outer side, the tip portion of the sheet is fixed to the rotating shaft 44, and the sheet is rewound to be wound around the rotating shaft 44 by rotating the rotating shaft 44 in the arrow a direction.

When the second unwinding and rewinding device 40 is used as the unwinder and when the second unwinding and rewinding device 40 is used as the rewinder, the directions, in which the sheets are wound around the rotating shaft 44, become directions opposite to each other. Moreover, when the second unwinding and rewinding device 40 is used as the unwinder, the second unwinding and rewinding device 40 may supply (refer to FIG. 13) the sheet so that the image is formed on the rear surface of the wound sheet as described below, instead of supplying the sheet to form the image on the front surface of the wound sheet. Moreover, when the second unwinding and rewinding device 40 is used as the rewinder, the second unwinding and rewinding device 40 may rewind (refer to FIG. 14) the sheet so that the surface on which the image is formed is toward the inner side as described below, instead of rewinding the sheet so that the surface on which the image is formed is toward the outer side in the state where the sheet is wound.

Moreover, the second unwinding and rewinding device 40 is disposed so that an upper end portion of the second unwinding and rewinding device 40 is positioned below the lower end portion of the first image forming portion 100 and the lower end portion of the second image forming portion 200 in the direction of gravity. Moreover, at least a portion of the second unwinding and rewinding device 40 is disposed below the second image forming portion 200 in the direction of gravity to overlap with the second image forming portion 200 in the direction of gravity.

FIG. 1 shows a state where the first unwinding and rewinding device 30 is used as the unwinder that supplies the sheet and the second unwinding and rewinding device 40 is used as the rewinder that rewinds the sheet.

In the first unwinding and rewinding device 30 and the second unwinding and rewinding device 40, when one is used as the unwinder, the other is used as the rewinder. Moreover, a function of the first unwinding and rewinding device 30 and a function of the second unwinding and rewinding device 40 may be switched with each other. That is, as described above, the first unwinding and rewinding device 30 may be used as the unwinder, the second unwinding and rewinding device 40 may be used as the rewinder, the first unwinding and rewinding device 30 may be used as the rewinder, and the second unwinding and rewinding device 40 may be used as the unwinder.

As described above, instead of the function of the first unwinding and rewinding device 30 and the function of the second unwinding and rewinding device 40 being switched with each other, a position of the first unwinding and rewinding device 30 and a position of the second unwinding and rewinding device 40 may be switched with each other. For example, the first unwinding and rewinding device 30 is used as the unwinder that exclusively supplies the sheet and the second unwinding and rewinding device 40 is used to exclusively rewind the sheet, the first unwinding and rewinding device 30 and the second unwinding and rewinding device 40 may be attached to and detached from the image forming apparatus body 12, and dispositions of the first unwinding and rewinding device 30 and the second unwinding and rewinding device 40 in the image forming apparatus body 12 may be switched with each other.

In addition, instead of the first unwinding and rewinding device 30 and the second unwinding and rewinding device 40 having both the function of supplying the sheet wound in a roll shape in the longitudinal direction and the function of supplying the sheet to be wound in a roll shape in the longitudinal direction as described above, one of the first unwinding and rewinding device 30 and the second unwinding and rewinding device 40 may supply a folded web, and the other of the first unwinding and rewinding device 30 and the second unwinding and rewinding device 40 may rewind the sheet to be folded. In this case, preferably, the positions of the first unwinding and rewinding device 30 and the second unwinding and rewinding device 40 are switched with each other.

In addition, instead of the first unwinding and rewinding device 30 and the second unwinding and rewinding device 40 having both the function of supplying the sheet wound in a roll shape and the function of supplying the sheet to be wound in a roll shape as described above, for example, one of the first unwinding and rewinding device 30 and the second unwinding and rewinding device 40 may supply plural sheets cut into A4 size, A3 size, or the like, and the other of the first unwinding and rewinding device 30 and the second unwinding and rewinding device 40 may rewind the cut sheets. In this case, preferably, the positions of the first unwinding and rewinding device 30 and the second unwinding and rewinding device 40 are switched with each other.

In addition, instead of the first unwinding and rewinding device 30 and the second unwinding and rewinding device 40 being disposed in the image forming apparatus body 12, at least one of the first unwinding and rewinding device 30 and the second unwinding and rewinding device 40 may be disposed outside the image forming apparatus body 12. Moreover, at least one of the first unwinding and rewinding device 30 and the second unwinding and rewinding device 40 may be a device separated from the image forming apparatus 10, and at least one of an insertion hole for inserting the sheet from the outside of the image forming apparatus body 12 and a discharge hole for discharging the sheet from the inside of the image forming apparatus body 12 may be provided in the image forming apparatus body 12.

The first image forming portion 100 is one of plural image forming portions that form an image on the sheet, and includes a body portion 102. For example, an insertion hole 104 used to insert the sheet is formed on a bottom surface of the body portion 102. Moreover, a discharge hole 106 used to discharge the sheet, on which the image is formed, is formed on a side surface of the second image forming portion 200 side in the body portion 102. In addition, a discharge hole 108 used to discharge the sheet, on which the image is formed, is formed on a side surface opposite to the second image forming portion 200 side in the body portion 102. Either the discharge hole 106 or the discharge hole 108 is used according to whether any one of a first transport path 412, a second transport path 414, a third transport path 416, and a fourth transport path 418 described below is used. Moreover, the body portion 102 may not be provided, and each member configuring the first image forming portion 100 described below may be directly disposed inside the image forming apparatus body 12.

Moreover, the first image forming portion 100 includes a toner image forming portion 110Y for forming a yellow toner image, a toner image forming portion 110M for forming a magenta toner image, a toner image forming portion 110C for forming a cyan toner image, and a toner image forming portion 110K for forming a black toner image. Each of the toner image forming portion 110Y, the toner image forming portion 110M, the toner image forming portion 110C, and the toner image forming portion 110K is used as a single color image forming portion that forms a single color image, and for example, adopts an electrophotographic method. Moreover, for example, each of the toner image forming portion 110Y, the toner image forming portion 110M, the toner image forming portion 110C, and the toner image forming portion 110K includes a photoconductor 112 on which a latent image is formed by a latent image forming device (not shown) such as a laser irradiation device, and a developing device 114 that develops the latent image formed on the photoconductor 112 using toner.

In addition, each of the toner image forming portion 110Y, the toner image forming portion 110M, the toner image forming portion 110C, and the toner image forming portion 110K includes a charging device (not shown) that charges a surface of the photoconductor 112, a primary transfer device (not shown) for transferring the toner image to an intermediate image transfer belt 120 described below, and a cleaning device (not shown) that cleans the surface of the photoconductor 112 after the toner image is transferred.

Moreover, the first image forming portion 100 includes the intermediate image transfer belt 120, the toner images formed by the toner image forming portion 110Y, the toner image forming portion 110M, the toner image forming portion 110C, and the toner image forming portion 110K are transferred to be overlapped on the surface of the intermediate image transfer belt 120, and the toner images transferred to be overlapped are transferred to the sheet by a secondary transfer device 122.

Moreover, the first image forming portion 100 includes a fixing device 130 that fixes the toner image transferred to the sheet with respect to the sheet using heat and pressure, for example.

The second image forming portion 200 is one of plural image forming portions that form an image on the sheet, and includes a body portion 202. For example, an insertion hole 204 used to insert the sheet is formed on a bottom surface of the body portion 202. Moreover, a discharge hole 206 used to discharge the sheet, on which the image is formed, is formed on a side surface opposite to the first image forming portion 100 side in the body portion 202. In addition, a discharge hole 208 used to discharge the sheet, on which the image is formed, is formed on a side surface of the first image forming portion 100 side in the body portion 202. Either the discharge hole 206 or the discharge hole 208 is used according to whether any one of the first transport path 412, the second transport path 414, the third transport path 416, and the fourth transport path 418 described below is used. Moreover, the body portion 202 may not be provided, and each member configuring the second image forming portion 200 described below may be directly disposed inside the image forming apparatus body 12.

Moreover, the second image forming portion 200 includes a toner image forming portion 210W for forming a white toner image, a toner image forming portion 210G for forming a gold toner image, a toner image forming portion 210S for forming a silver toner image, and a toner image forming portion 210T for forming a transparent toner image. Each of the toner image forming portion 210W, the toner image forming portion 210G, the toner image forming portion 210S, and the toner image forming portion 210T is used as a single color image forming portion that forms a single color image, and for example, adopts an electrophotographic method. Moreover, each of the toner image forming portion 210W, the toner image forming portion 210G, the toner image forming portion 210S, and the toner image forming portion 210T includes a photoconductor 212 on which a latent image is formed by a latent image forming device (not shown) such as a laser irradiation device, and a developing device 214 that develops the latent image formed on the photoconductor 212 using toner.

In addition, each of the toner image forming portion 210W, the toner image forming portion 210G, the toner image forming portion 210S, and the toner image forming portion 210T includes a charging device (not shown) that charges a surface of the photoconductor 212, a primary transfer device (not shown) for transferring the toner image to an intermediate image transfer belt 220 described below, and a cleaning device (not shown) that cleans the surface of the photoconductor 212 after the toner image is transferred.

Moreover, the second image forming portion 200 includes the intermediate image transfer belt 220, the toner images formed by the toner image forming portion 210W, the toner image forming portion 210G, the toner image forming portion 210S, and the toner image forming portion 210T are transferred to be overlapped on the surface of the intermediate image transfer belt 220, and the toner images transferred to be overlapped are transferred to the sheet by a secondary transfer device 222.

Moreover, the second image forming portion 200 includes a fixing device 230 that fixes the toner image transferred to the sheet with respect to the sheet using heat and pressure, for example.

The transport mechanism 400 is used as a transport unit that transports the sheet to at least one image forming portion that is selected from the first image forming portion 100 and the second image forming portion 200. In addition, the transport mechanism 400 includes plural transport paths that are different at least in the image forming portion, to which the sheet is transported, out of the first image forming portion 100 and the second image forming portion 200, and in an order of the sheet transported with respect to each image forming portion on which the image is formed. More specifically, the transport mechanism 400 includes the first transport path 412 (refer to FIG. 2) through which the sheet is transported to the first image forming portion 100 and the sheet is not transported to the second image forming portion 200, the second transport path 414 (refer to FIG. 3) through which the sheet is transported to the second image forming portion 200 and the sheet is not transported to the first image forming portion 100, the third transport path 416 (refer to FIG. 4) through which the sheet is transported to the second image forming portion 200 after the sheet is transported to the first image forming portion 100, and the fourth transport path 418 (refer to FIG. 5) through which the sheet is transported to the first image forming portion 100 after the sheet is transported to the second image forming portion 200. In the first transport path 412, the second transport path 414, the third transport path 416, and the fourth transport path 418, only the third transport path 416 is shown in FIG. 1. Moreover, the first transport path 412, the second transport path 414, the third transport path 416, and the fourth transport path 418 overlap with one another in at least a portion.

In addition, the transport mechanism 400 includes plural rollers that are disposed at positions along one or more paths of the first transport path 412, the second transport path 414, the third transport path 416, and the fourth transport path 418 to transport the sheet. That is, the transport mechanism 400 includes a transport roller 432, a transport roller 434, a transport roller 436, a transport roller 438, a transport roller 440, a transport roller 442, a transport roller 444, and a transport roller 446. All or a portion of the rollers may be rotated in both directions, the rotation direction of the roller is switched, and thus, the direction in which the sheet is transported may be switched in at least a portion of the transport mechanism 400.

Figure 2:
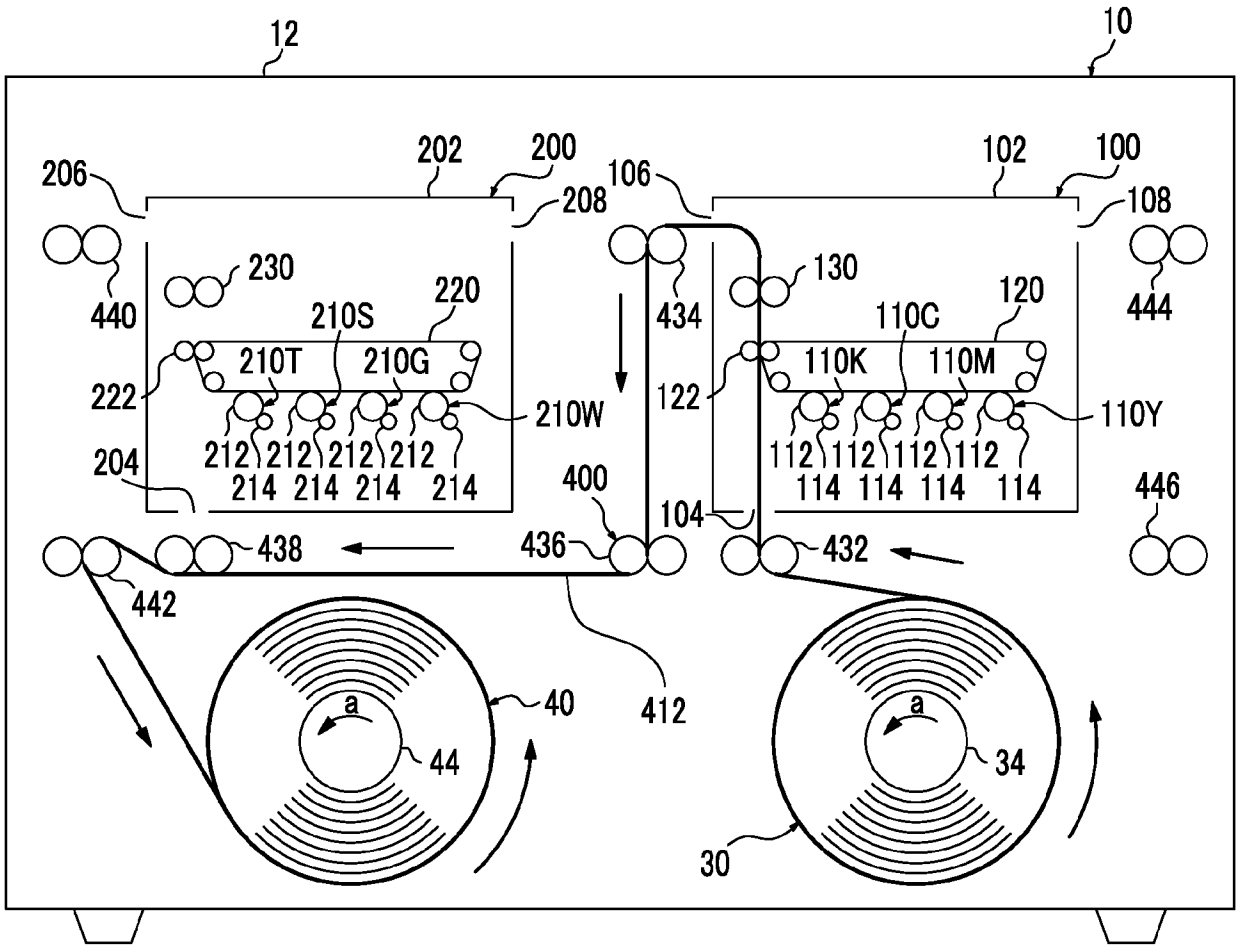
FIG. 2 is a diagram showing a state where a recording medium is transported using a first transport path of the image forming apparatus shown in FIG. 1.

FIG. 2 shows the image forming apparatus 10 in which the sheet is transported using the first transport path 412. In this state, the sheet, which is supplied from the first unwinding and rewinding device 30 so that the image is formed on the front surface of the wound sheet, is fed into the body portion 102 to pass through the insertion hole 104 by the transport roller 432, the toner image is transferred to the sheet by the secondary transfer device 122, the sheet, which is discharged from the body portion 102 to pass through the discharge hole 106, is transported to the second unwinding and rewinding device 40 by the transport roller 434, the transport roller 436, the transport roller 438, and the transport roller 442 without being transported to the second image forming portion 200, and thus, the sheet is rewound by the second unwinding and rewinding device 40 so that the surface of the sheet on which the image is formed is toward the outer side. In the state where the first transport path 412 is used, the image may be formed on the sheet by only the first image forming portion 100, and the image is not formed on the sheet by the second image forming portion 200.

Figure 3:
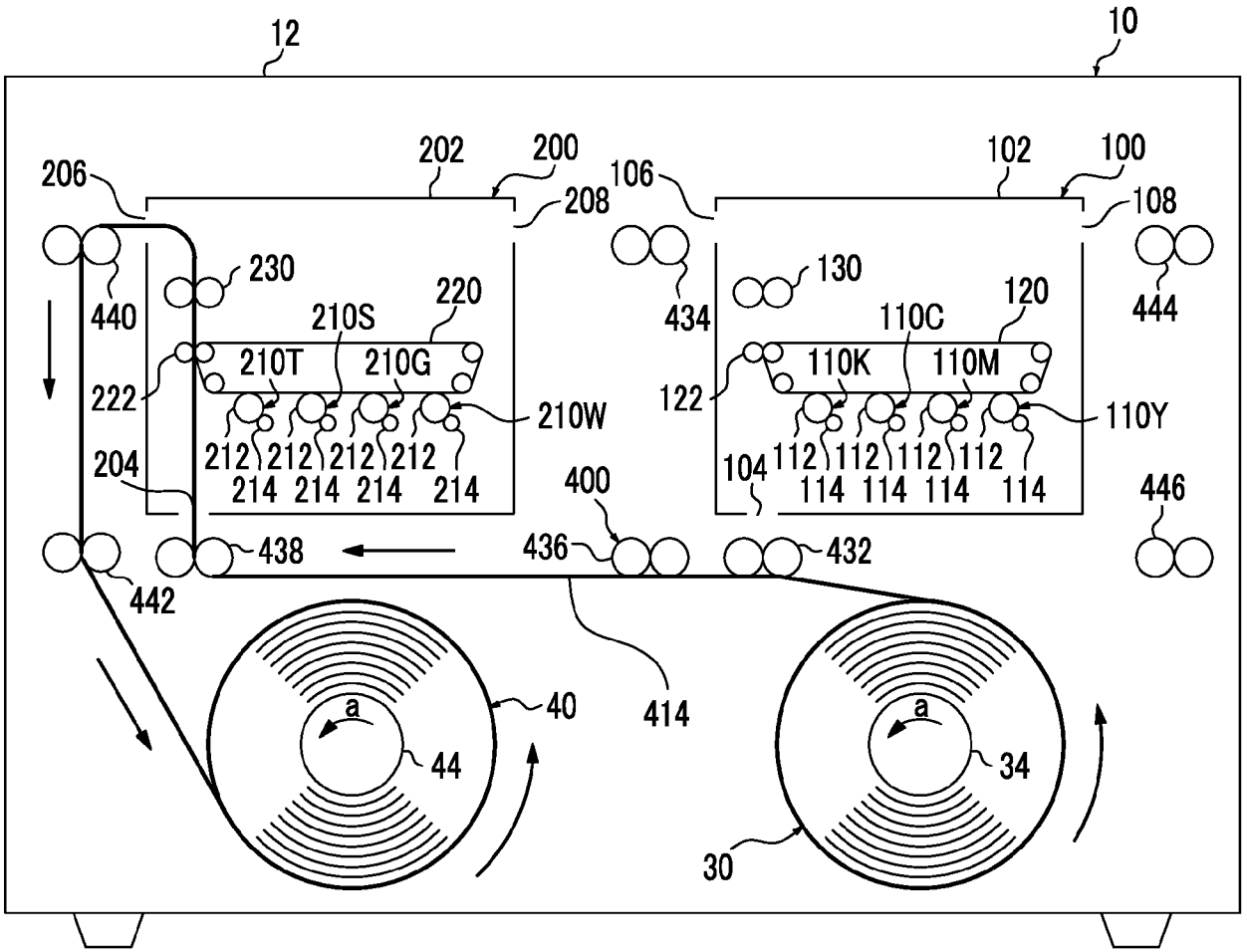
FIG. 3 is a diagram showing a state where the recording medium is transported using a second transport path of the image forming apparatus shown in FIG. 1.

FIG. 3 shows the image forming apparatus 10 in which the sheet is transported using the second transport path 414. In this state, the sheet, which is supplied from the first unwinding and rewinding device 30 so that the image is formed on the front surface of the wound sheet, is fed into the body portion 202 to pass through the insertion hole 204 by the transport roller 432, the transport roller 436, and the transport roller 438, the toner image is transferred to the sheet by the secondary transfer device 222, the sheet, which is discharged from the body portion 202 to pass through the discharge hole 206, is transported to the second unwinding and rewinding device 40 by the transport roller 440 and the transport roller 442, and thus, the sheet is rewound by the second unwinding and rewinding device 40 so that the surface of the sheet on which the image is formed is toward the outer side. In the state where the second transport path 414 is used, the image may be formed on the sheet by only the second image forming portion 200, and the image is not formed on the sheet by the first image forming portion 100.

Figure 4:
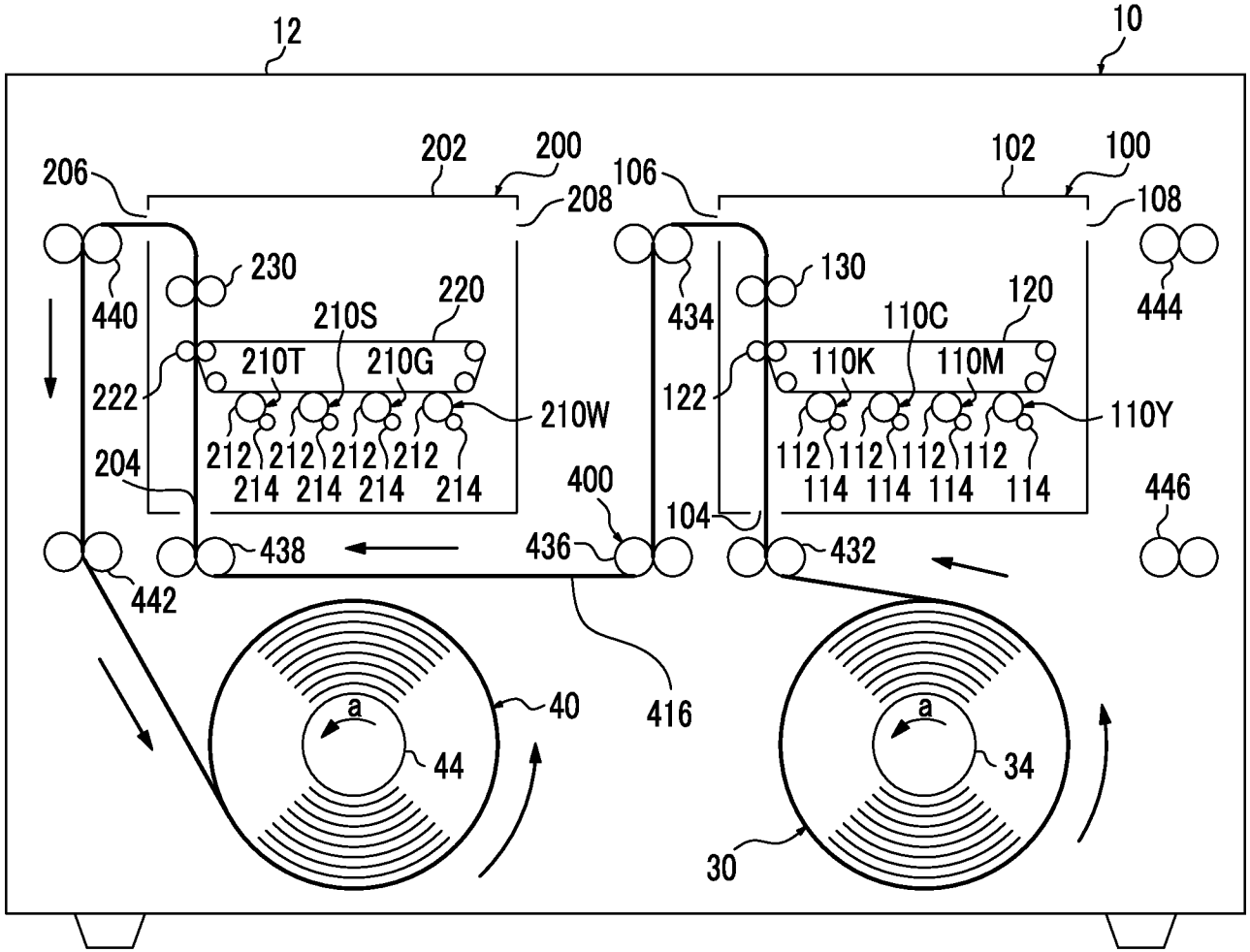
FIG. 4 is a diagram showing a state where the recording medium is transported using a third transport path of the image forming apparatus shown in FIG. 1.

FIG. 4 shows the image forming apparatus 10 in which the sheet is transported using the third transport path 416. In this state, the sheet, which is supplied from the first unwinding and rewinding device 30 so that the image is formed on the front surface of the wound sheet, is fed into the body portion 102 to pass through the insertion hole 104 by the transport roller 432, the toner image is transferred to the sheet by the secondary transfer device 122, the sheet, which is discharged from the body portion 102 to pass through the discharge hole 106, is fed into the body portion 202 to pass through the insertion hole 204 by the transport roller 434, the transport roller 436, and the transport roller 438. Moreover, the toner image is transferred to the sheet by the secondary transfer device 222, the sheet discharged to pass through the discharge hole 206 is transported to the second unwinding and rewinding device 40 by the transport roller 440 and the transport roller 442, and thus, the sheet is rewound by the second unwinding and rewinding device 40 so that the surface of the sheet on which the image is formed is toward the outer side. In this state, the image is formed on the sheet by the first image forming portion 100, and an image is formed on the sheet by the second image forming portion 200 to overlap with the sheet on which the image is formed by the first image forming portion 100.

Figure 5:
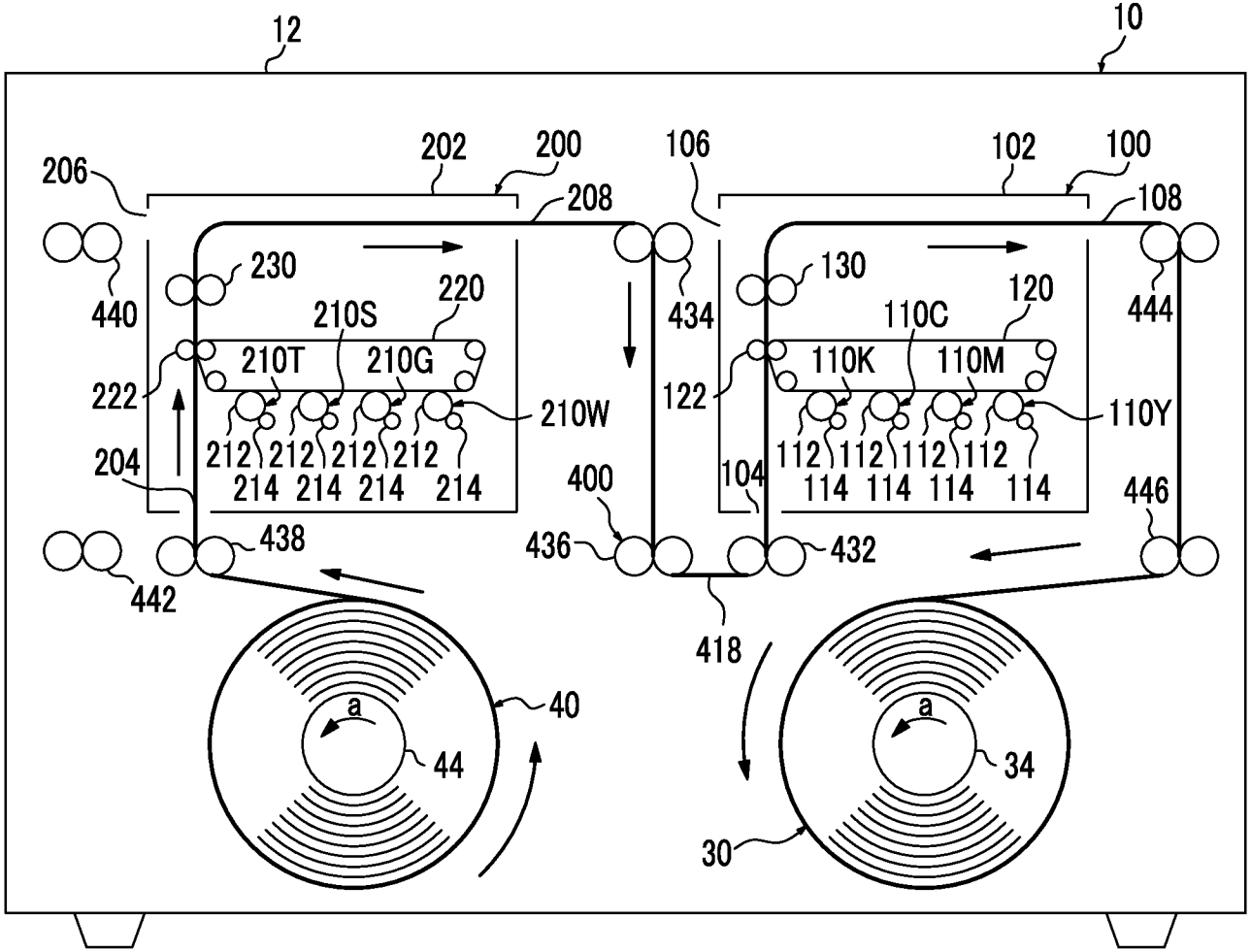
FIG. 5 is a diagram showing a state where the recording medium is transported using a fourth transport path of the image forming apparatus shown in FIG. 1.

FIG. 5 shows the image forming apparatus 10 in which the sheet is transported using the fourth transport path 418. In this state, the sheet, which is supplied from the second unwinding and rewinding device 40 so that the image is formed on the front surface of the wound sheet, is fed into the body portion 202 to pass through the insertion hole 204 by the transport roller 438, the toner image is transferred to the sheet by the secondary transfer device 222, the sheet, which is discharged from the body portion 202 to pass through the discharge hole 208, is fed into the body portion 102 to pass through the insertion hole 104 by the transport roller 434, the transport roller 436, and the transport roller 432. In addition, the toner image is transferred to the sheet by the secondary transfer device 122, the sheet discharged to pass through the discharge hole 108 is transported to the first unwinding and rewinding device 30 by the transport roller 444 and the transport roller 446, and thus, the sheet is rewound by the first unwinding and rewinding device 30 so that the surface of the sheet on which the image is formed is toward the outer side. In this state, the image is formed on the sheet by the second image forming portion 200, and an image is formed on the sheet by the first image forming portion 100 to overlap with the sheet on which the image is formed by the second image forming portion 200.

As describe above, in the image forming apparatus 10 according to the first exemplary embodiment, the image may be formed on the sheet only by the first image forming portion 100 using the first transport path 412, the image may be formed on the sheet only by the second image forming portion 200 using the second transport path 414, an image may be formed by the second image forming portion 200 to overlap with the image formed by the first image forming portion 100, using the third transport path 416, and an image may be formed by the first image forming portion 100 to overlap with the image formed by the second image forming portion 200, using the fourth transport path 418.

Figure 6:
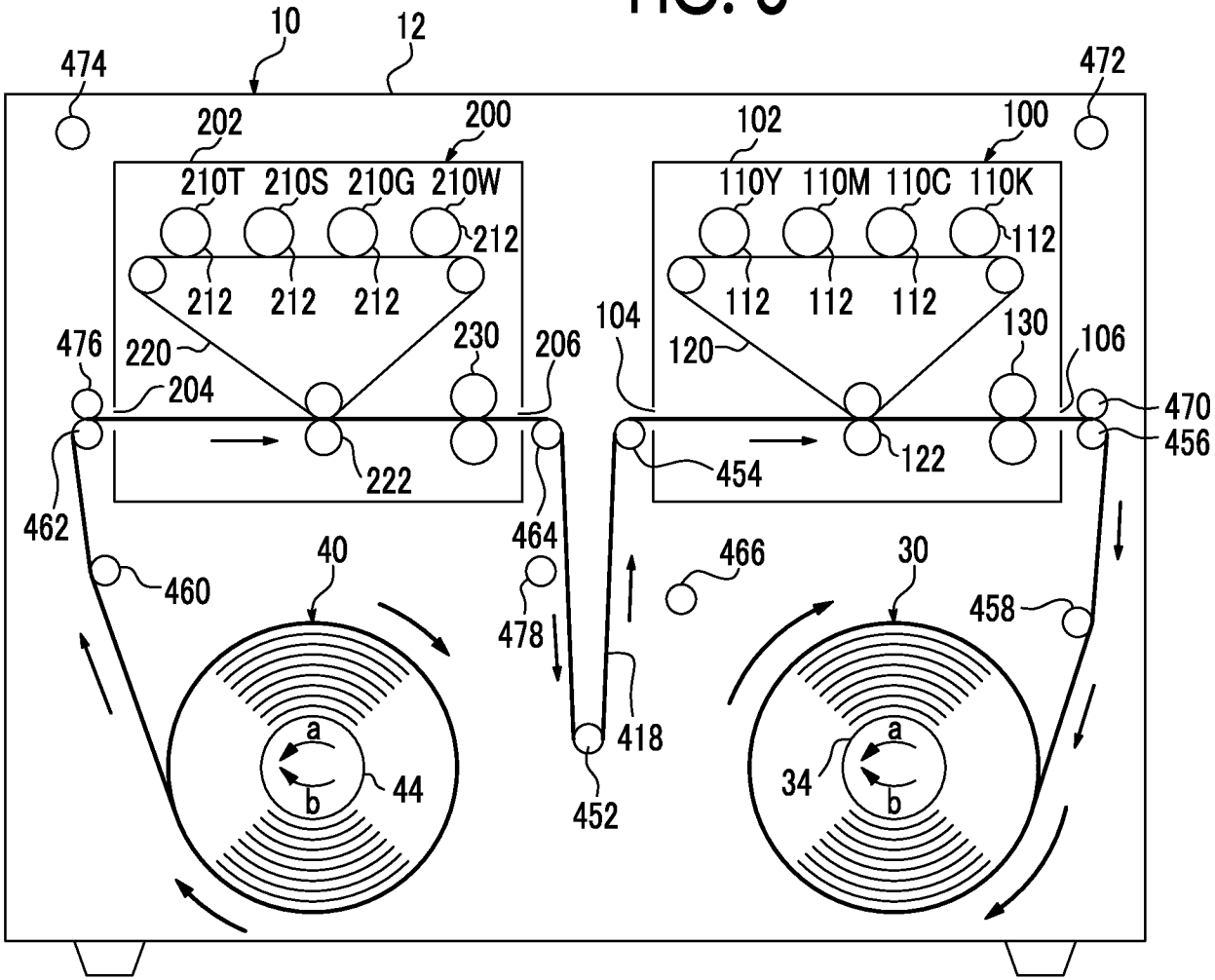
FIG. 6 is a diagram showing an image forming apparatus according to a second exemplary embodiment of the present invention.

FIG. 6 shows the image forming apparatus 10 according to a second exemplary embodiment of the present invention. In the image forming apparatus 10 according to the above-described first exemplary embodiment, the insertion hole 104 is formed on the bottom surface of the body portion 102, and the insertion hole 204 is formed on the bottom surface of the body portion 202. On the other hand, in the image forming apparatus 10 according to the second exemplary embodiment, the insertion hole 104 is formed on the side surface of the second image forming portion 200 side of the body portion 102, and the insertion hole 204 is formed on the side surface of the side opposite to the first image forming portion 100 of the body portion 202. Moreover, in the image forming apparatus 10 according to the above-described first exemplary embodiment, two discharge holes are formed on both the body portion 102 and the body portion 202. On the other hand, in the second exemplary embodiment, one discharge hole 106 is formed on the body portion 102, and one discharge hole 206 is formed on the body portion 202. That is, the discharge hole 106 is formed on the side surface of the side opposite to the second image forming portion 200 of the body portion 102, and the discharge hole 206 is formed on the side surface of the first image forming portion 100 side of the body portion 202.

Moreover, similar to the image forming apparatus 10 according to the above-described first exemplary embodiment, the transport mechanism 400 included in the image forming apparatus 10 according to the second exemplary embodiment includes the first transport path 412 (refer to FIG. 7) through which the sheet is transported to the first image forming portion 100 and the sheet is not transported to the second image forming portion 200, the second transport path 414 (refer to FIG. 8) through which the sheet is transported to the second image forming portion 200 and the sheet is not transported to the first image forming portion 100, the third transport path 416 (refer to FIG. 9) through which the sheet is transported to the second image forming portion 200 after the sheet is transported to the first image forming portion 100, and the fourth transport path 418 (refer to FIG. 10) through which the sheet is transported to the first image forming portion 100 after the sheet is transported to the second image forming portion 200. However, between the image forming apparatus 10 according to the secondary exemplary embodiment and the above-described image forming apparatus 10 according to the first exemplary embodiment, there is a difference that dispositions of respective transport paths in the image forming apparatus body 12 are different from each other. In the first transport path 412, the second transport path 414, the third transport path 416, and the fourth transport path 418, only the fourth transport path 418 is shown in FIG. 6. Moreover, the first transport path 412, the second transport path 414, the third transport path 416, and the fourth transport path 418 overlap with one another in at least a portion.

In addition, the transport mechanism 400 includes plural rollers that are disposed at positions along one or more paths of the first transport path 412, the second transport path 414, the third transport path 416, and the fourth transport path 418 to transport the sheet. That is, the transport mechanism 400 includes a transport roller 452, a transport roller 454, a transport roller 456, a transport roller 458, a transport roller 460, a transport roller 462, a transport roller 464, a transport roller 466, a transport roller 468, a transport roller 470, a transport roller 476, and a transport roller 478. All or a portion of the rollers may be rotated in both directions, the rotation direction of the roller is switched, and thus, the direction in which the sheet is transported may be switched in at least a portion of the transport mechanism 400.

Moreover, in FIG. 6, the developing device 114 shown in FIG. 1 is not shown. However, each of the toner image forming portion 110Y, the toner image forming portion 110M, the toner image forming portion 110C, the toner image forming portion 110K, the toner image forming portion 210W, the toner image forming portion 210G, the toner image forming portion 210S, and the toner image forming portion 210T includes the developing device. In addition, with respect to the same portions as the configurations of the image forming apparatus 10 according to the first exemplary embodiment shown in FIG. 1, the same reference numerals as those of FIG. 1 are assigned to FIG. 6, and descriptions thereof are omitted.

Figure 7:
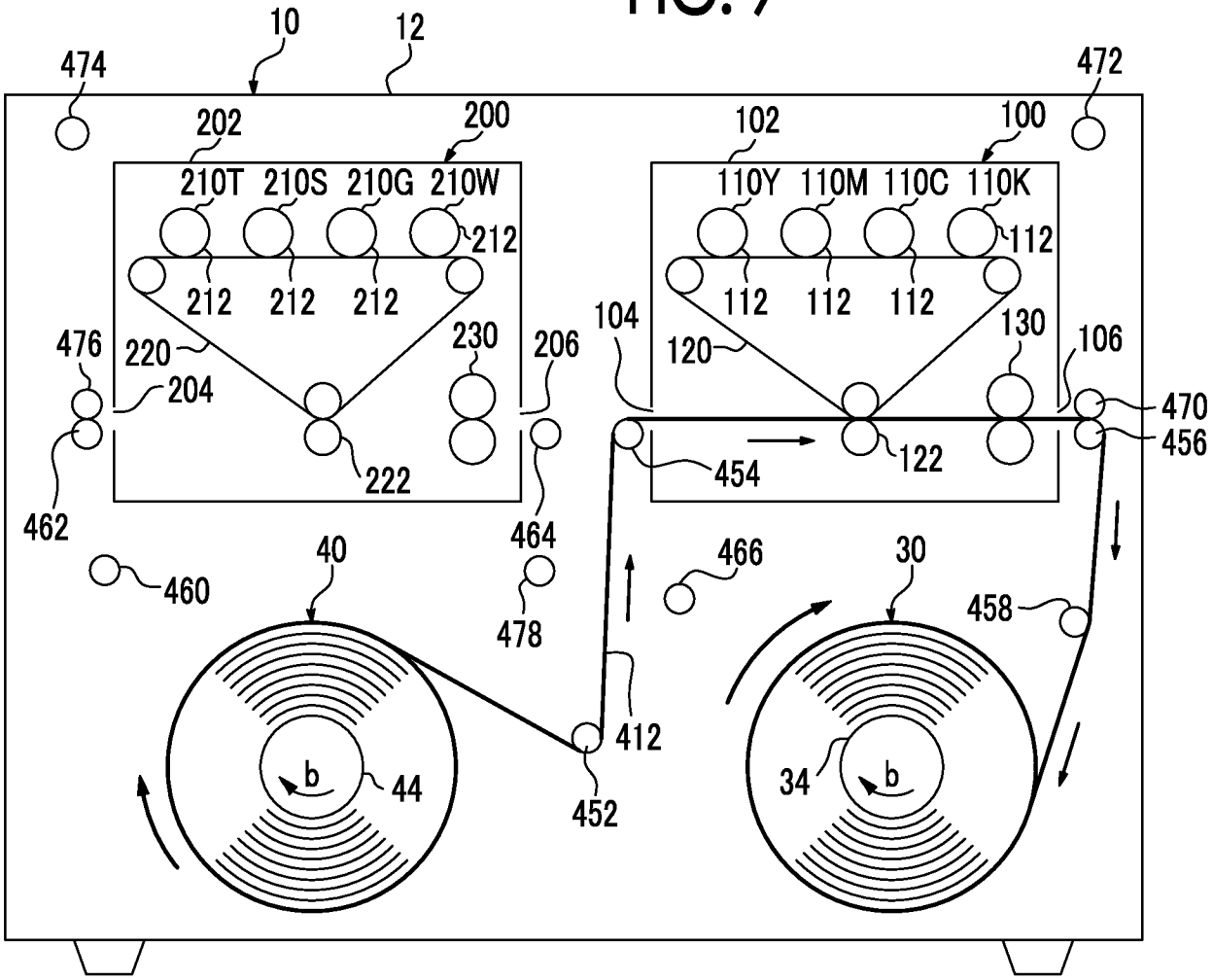
FIG. 7 is a diagram showing a state where a recording medium is transported using a first transport path of the image forming apparatus shown in FIG. 6.

FIG. 7 shows the image forming apparatus 10 in which the sheet is transported using the first transport path 412. In this state, the sheet, which is supplied from the second unwinding and rewinding device 40 so that the image is formed on the front surface of the wound sheet, is fed into the body portion 102 to pass through the insertion hole 104 by the transport roller 452 and the transport roller 454, the toner image is transferred to the sheet by the secondary transfer device 122, the sheet, which is discharged from the body portion 102 to pass through the discharge hole 106, is transported to the first unwinding and rewinding device 30 by the transport roller 456 and the transport roller 458 without being transported to the second image forming portion 200, and thus, the sheet is rewound by the first unwinding and rewinding device 30 so that the surface of the sheet on which the image is formed is toward the outer side. In the state where the first transport path 412 is used, the image may be formed on the sheet by only the first image forming portion 100, and the image is not formed on the sheet by the second image forming portion 200.

Figure 8:
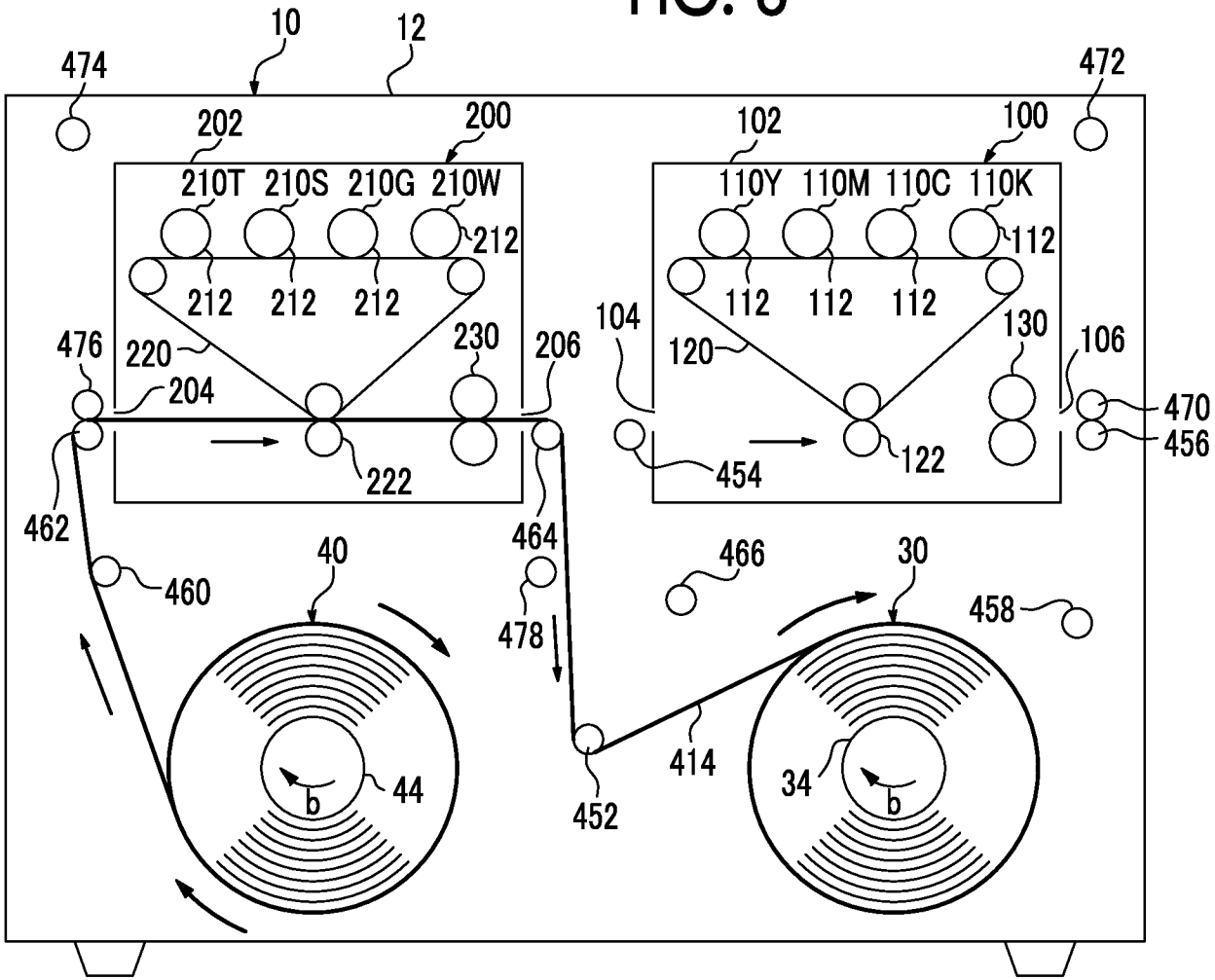
FIG. 8 is a diagram showing a state where the recording medium is transported using a second transport path of the image forming apparatus shown in FIG. 6.

FIG. 8 shows the image forming apparatus 10 in which the sheet is transported using the second transport path 414. In this state, the sheet, which is supplied from the second unwinding and rewinding device 40 so that the image is formed on the front surface of the wound sheet, is fed into the body portion 202 to pass through the insertion hole 204 by the transport roller 460 and the transport roller 462, the toner image is transferred to the sheet by the secondary transfer device 222, the sheet, which is discharged from the body portion 202 to pass through the discharge hole 206, is transported to the first unwinding and rewinding device 30 by the transport roller 464 and the transport roller 452, and thus, the sheet is rewound by the first unwinding and rewinding device 30 so that the surface of the sheet on which the image is formed is toward the outer side. In the state where the second transport path 414 is used, the image may be formed on the sheet by only the second image forming portion 200, and the image is not formed on the sheet by the first image forming portion 100.

Figure 9:
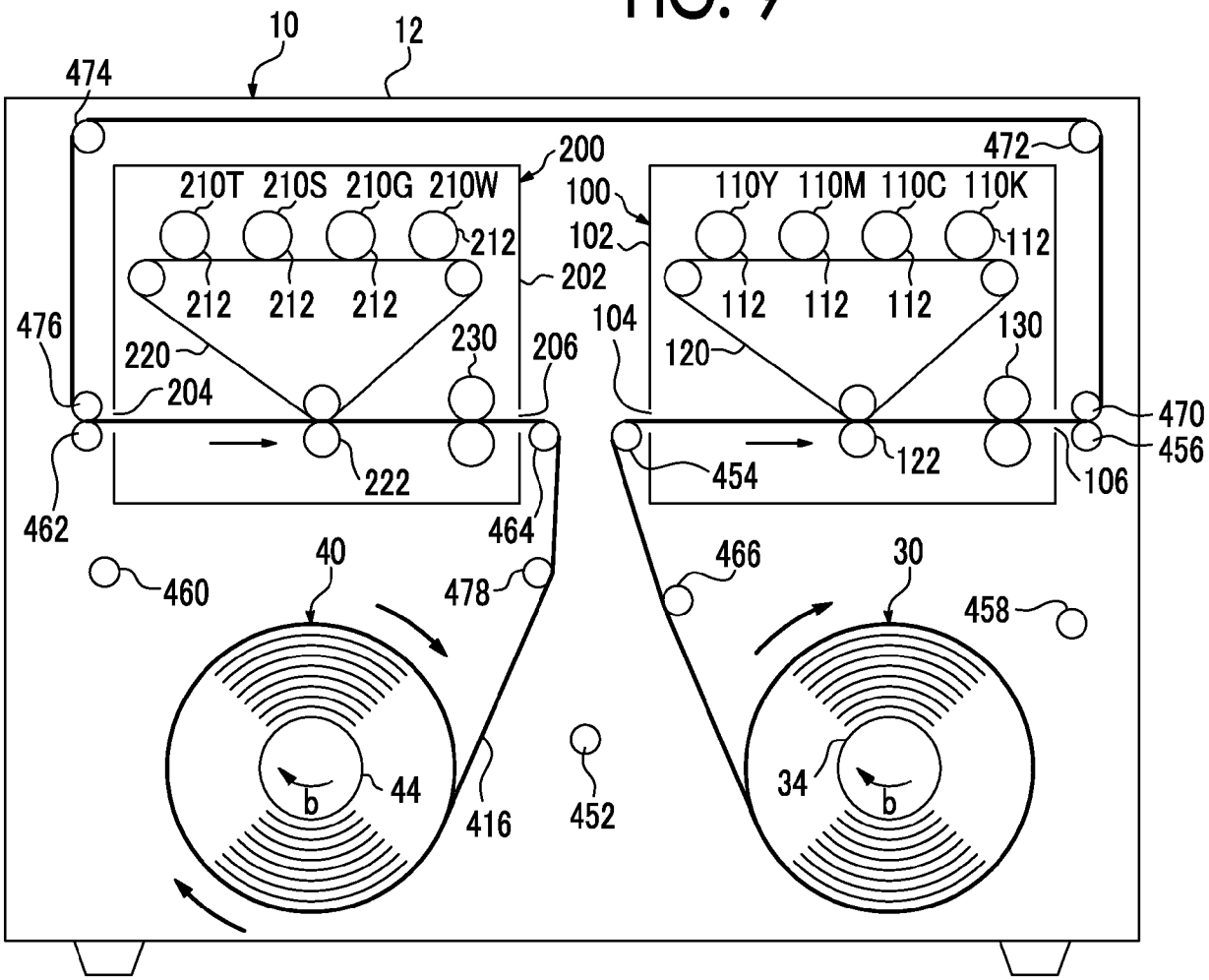
FIG. 9 is a diagram showing a state where the recording medium is transported using a third transport path of the image forming apparatus shown in FIG. 6.

FIG. 9 shows the image forming apparatus 10 in which the sheet is transported using the third transport path 416. In this state, the sheet, which is supplied from the first unwinding and rewinding device 30 so that the image is formed on the front surface of the wound sheet, is fed into the body portion 102 to pass through the insertion hole 104 by the transport roller 466 and the transport roller 454, the toner image is transferred to the sheet by the secondary transfer device 122, the sheet, which is discharged from the body portion 102 to pass through the discharge hole 106, is fed into the body portion 202 to pass through the insertion hole 204 by the transport roller 470, a transport roller 472, a transport roller 474, and the transport roller 476. Moreover, the toner image is transferred to the sheet by the secondary transfer device 222, the sheet discharged from the discharge hole 206 is transported to the second unwinding and rewinding device 40 by the transport roller 464 and the transport roller 478, and thus, the sheet is rewound by the second unwinding and rewinding device 40 so that the surface of the sheet, on which the image is formed is toward the outer side. In this state, the image is formed on the sheet by the first image forming portion 100, and an image is formed on the sheet by the second image forming portion 200 to overlap with the sheet on which the image is formed by the first image forming portion 100.

Figure 10:
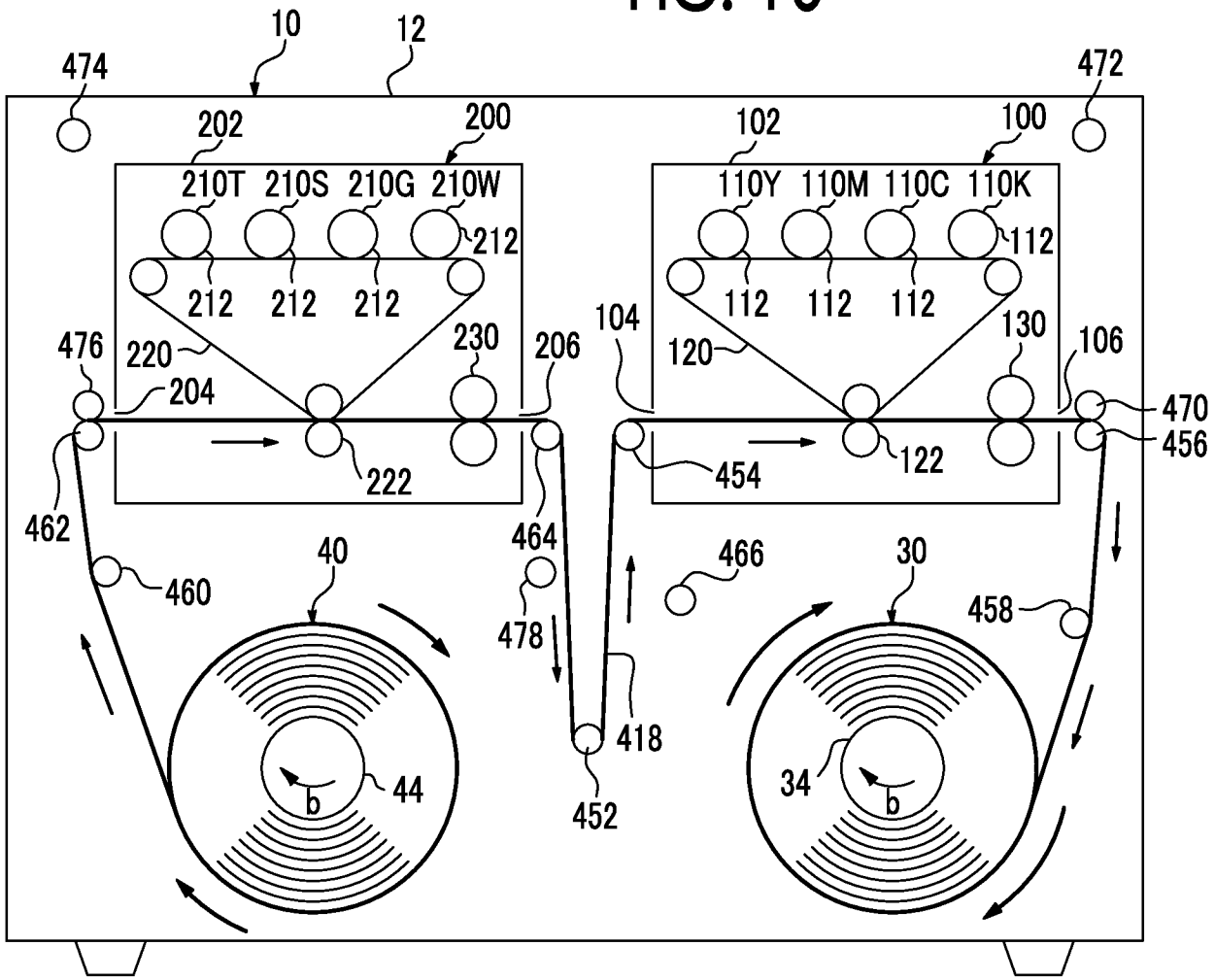
FIG. 10 is a diagram showing a state where the recording medium is transported using a fourth transport path of the image forming apparatus shown in FIG. 6.

FIG. 10 shows the image forming apparatus 10 in which the sheet is transported using the fourth transport path 418. In this state, the sheet, which is supplied from the second unwinding and rewinding device 40 so that the image is formed on the front surface of the wound sheet, is fed into the body portion 202 to pass through the insertion hole 204 by the transport roller 460 and the transport roller 462, the toner image is transferred to the sheet by the secondary transfer device 222, the sheet, which is discharged from the body portion 202 to pass through the discharge hole 206, is fed into the body portion 102 to pass through the insertion hole 104 by the transport roller 464, the transport roller 452, and the transport roller 454. In addition, the toner image is transferred to the sheet by the secondary transfer device 122, the sheet discharged to pass through the discharge hole 106 is transported to the first unwinding and rewinding device 30 by the transport roller 456 and the transport roller 458, and thus, the sheet is rewound by the first unwinding and rewinding device 30 so that the surface of the sheet on which the image is formed is toward the outer side. In the state where the fourth transport path 418 is used, the image is formed on the sheet by the second image forming portion 200, and an image is formed on the sheet by the first image forming portion 100 to overlap with the sheet on which the image is formed by the second image forming portion 200.

As described above, similar to the image forming apparatus according to the above-described first exemplary embodiment, also in the image forming apparatus 10 according to the second exemplary embodiment, the image may be formed on the sheet only by the first image forming portion 100 using the first transport path 412, the image may be formed on the sheet only by the second image forming portion 200 using the second transport path 414, an image may be formed by the second image forming portion 200 to overlap with the image formed by the first image forming portion 100, using the third transport path 416, and an image may be formed by the first image forming portion 100 to overlap with the image formed by the second image forming portion 200, using the fourth transport path 418.

In each exemplary embodiment described above, for example, out of the first transport path 412, the second transport path 414, the third transport path 416, and the fourth transport path 418, the one that may be used as the transport path may be determined by operating an operating unit (not shown) such as an operating panel and by deciding the rotation direction of each transport roller 432 or the like, in a state when forming of an image with respect to a new web or the like starts, the sheet is mounted on either the first unwinding and rewinding device 30 or the second unwinding and rewinding device 40 according to the selected transport path, the sheet is mounted so that the sheet is transported to each transport roller according to the selected transport path, the tip portion of the sheet is fixed to the rotating shaft (rotating shaft 34 or rotating shaft 44) of the other of the first unwinding and rewinding device 30 and the second unwinding and rewinding device 40.

Figure 11:
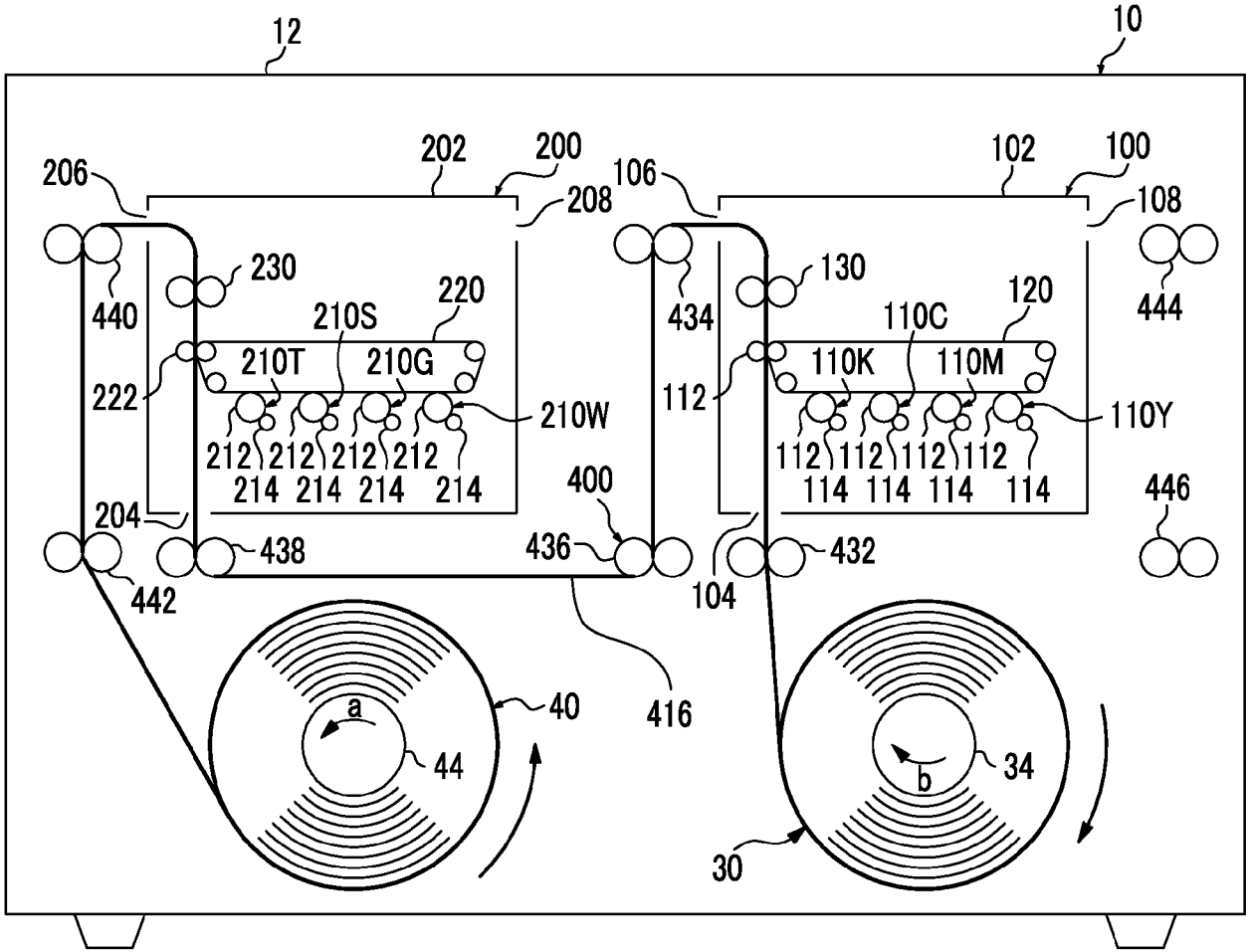
FIG. 11 is a diagram showing a state where the recording medium is supplied from a first unwinding and rewinding device so that the image is formed on a rear surface of the wound recording medium in the image forming apparatus shown in FIG. 1.

FIG. 11 is a diagram showing a state where the sheet is supplied from the first unwinding and rewinding device 30 so that the image is formed on the rear surface of the wound sheet in the image forming apparatus 10 according to the first exemplary embodiment. In the above descriptions, although any transport path is used, when the first unwinding and rewinding device 30 is used as the unwinder, the example, in which the first unwinding and rewinding device 30 supplies the sheet so that the image is formed on the front surface of the wound sheet, is described (refer to FIGS. 2, 3, and 4). However, as shown in FIG. 11, in the image forming apparatus 10 according to the first exemplary embodiment, the first unwinding and rewinding device 30 may supply the sheet so that an image is formed on the rear surface of the wound sheet.

In this case, as shown in FIG. 11, the sheet is attached to the rotating shaft 34 so that the direction of the sheet wound in the roll shape is opposite to the case shown in FIG. 2 or the like, and the rotating shaft 34 is controlled to be rotated in the arrow b direction. Moreover, the sheet is transported in the body portion 102 to pass through the insertion hole 104 by the transport roller 432.

Figure 12:
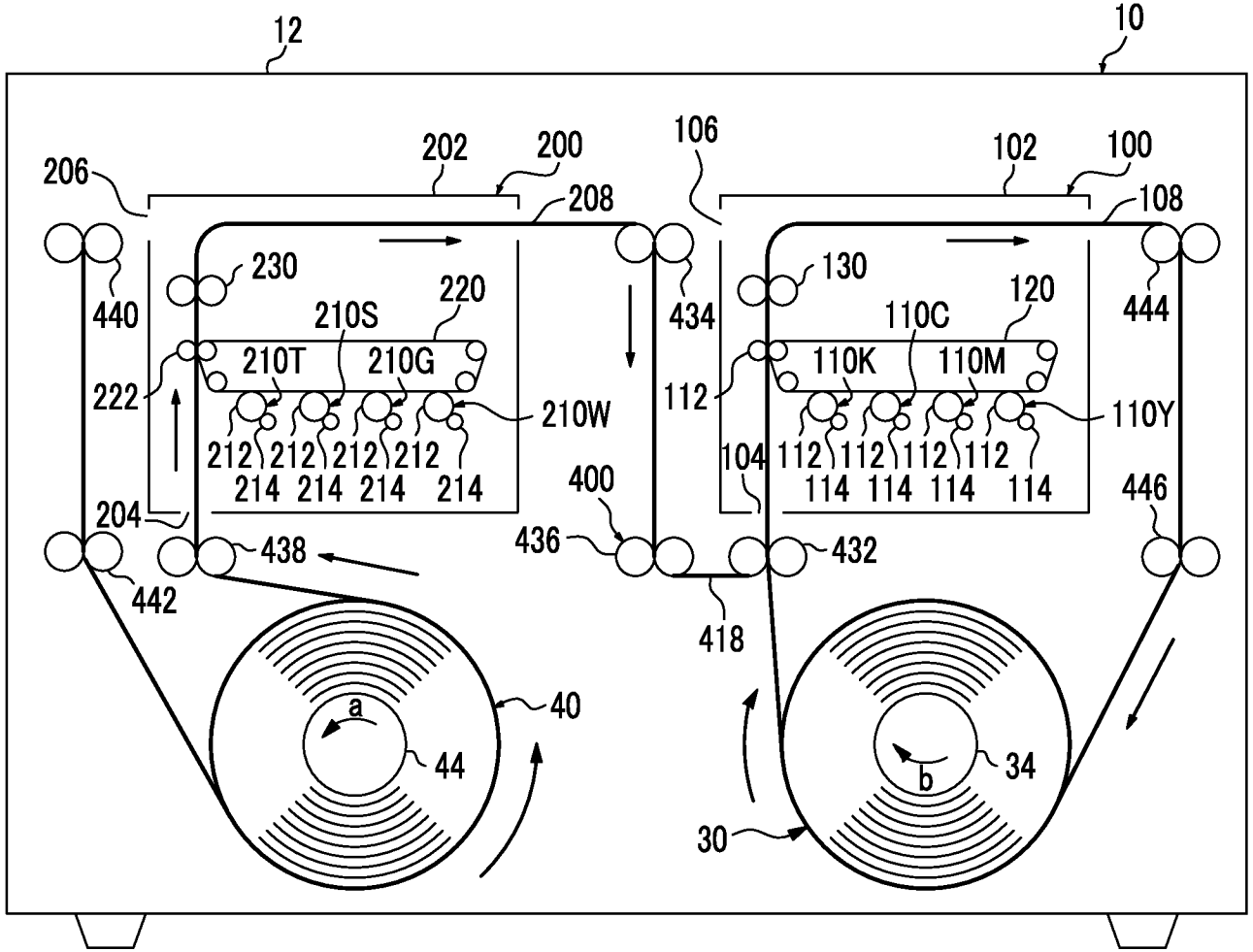
FIG. 12 is a diagram showing a state where the recording medium is rewound by the first unwinding and rewinding device so that a surface of the recording medium side, on which the image is formed, is toward the inner side, in the image forming apparatus shown in FIG. 1.

FIG. 12 shows a state where the sheet is rewound by the first unwinding and rewinding device 30 so that the surface of the sheet side, on which the image is formed, is toward the inner side, in the image forming apparatus 10 according to the first exemplary embodiment. In the above descriptions, when the first unwinding and rewinding device 30 is used as the rewinder using the fourth transport path 418, the example, in which the first unwinding and rewinding device 30 rewinds the sheet so that the surface of the sheet side on which the image is formed is toward the outer side, is described (refer to FIG. 5). However, as shown in FIG. 12, in the image forming apparatus 10 according to the first exemplary embodiment, the first unwinding and rewinding device 30 may rewind the sheet to be wound so that the surface of the sheet, on which the image is formed, is toward the inner side. In this case, the rotating shaft 34 is controlled to be rotated in the arrow b direction.

Figure 13:
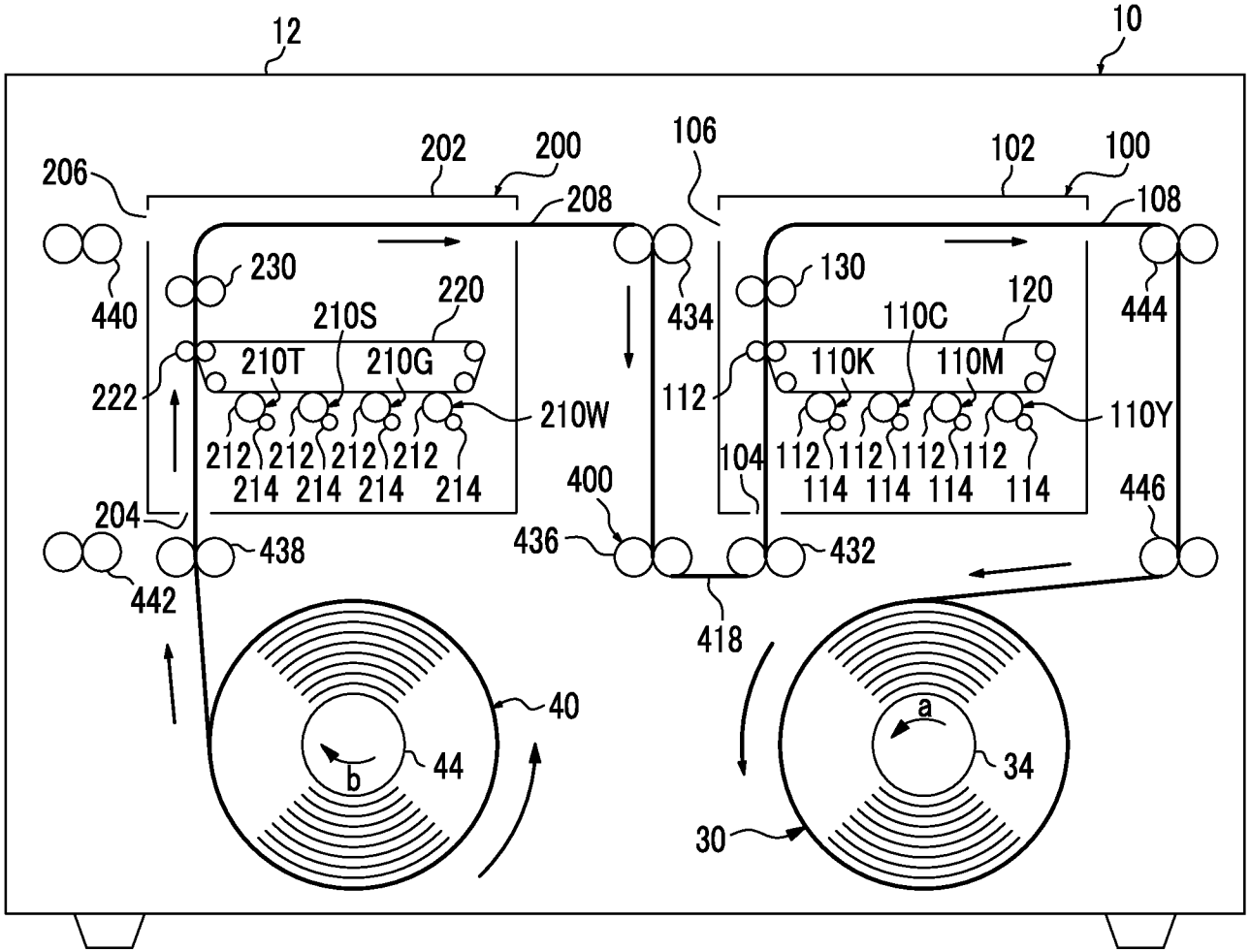
FIG. 13 is a diagram showing a state where the recording medium is supplied from a second unwinding and rewinding device so that the image is formed on the rear surface of the wound recording medium in the image forming apparatus shown in FIG. 1.

FIG. 13 shows a state where the sheet is supplied from the second unwinding and rewinding device 40 so that the image is formed on the rear surface of the wound sheet in the image forming apparatus 10 according to the first exemplary embodiment. In the above descriptions, when the second unwinding and rewinding device 40 is used as the unwinder using the fourth transport path 418, the example, in which the second unwinding and rewinding device 40 supplies the sheet so that the image is formed on the front surface of the wound sheet, is described (refer to FIG. 5). However, as shown in FIG. 13, in the image forming apparatus 10 according to the first exemplary embodiment, the second unwinding and rewinding device 40 may supply the sheet so that the image is formed on the rear surface of the wound sheet.

In this case, as shown in FIG. 13, the sheet is attached to the rotating shaft 44 so that the direction of the sheet wound in the roll shape is opposite to the case shown in FIG. 5, and the rotating shaft 44 is controlled to be rotated in the arrow b direction. Moreover, the sheet is transported in the body portion 202 to pass through the insertion hole 204 by the transport roller 438.

Figure 14:
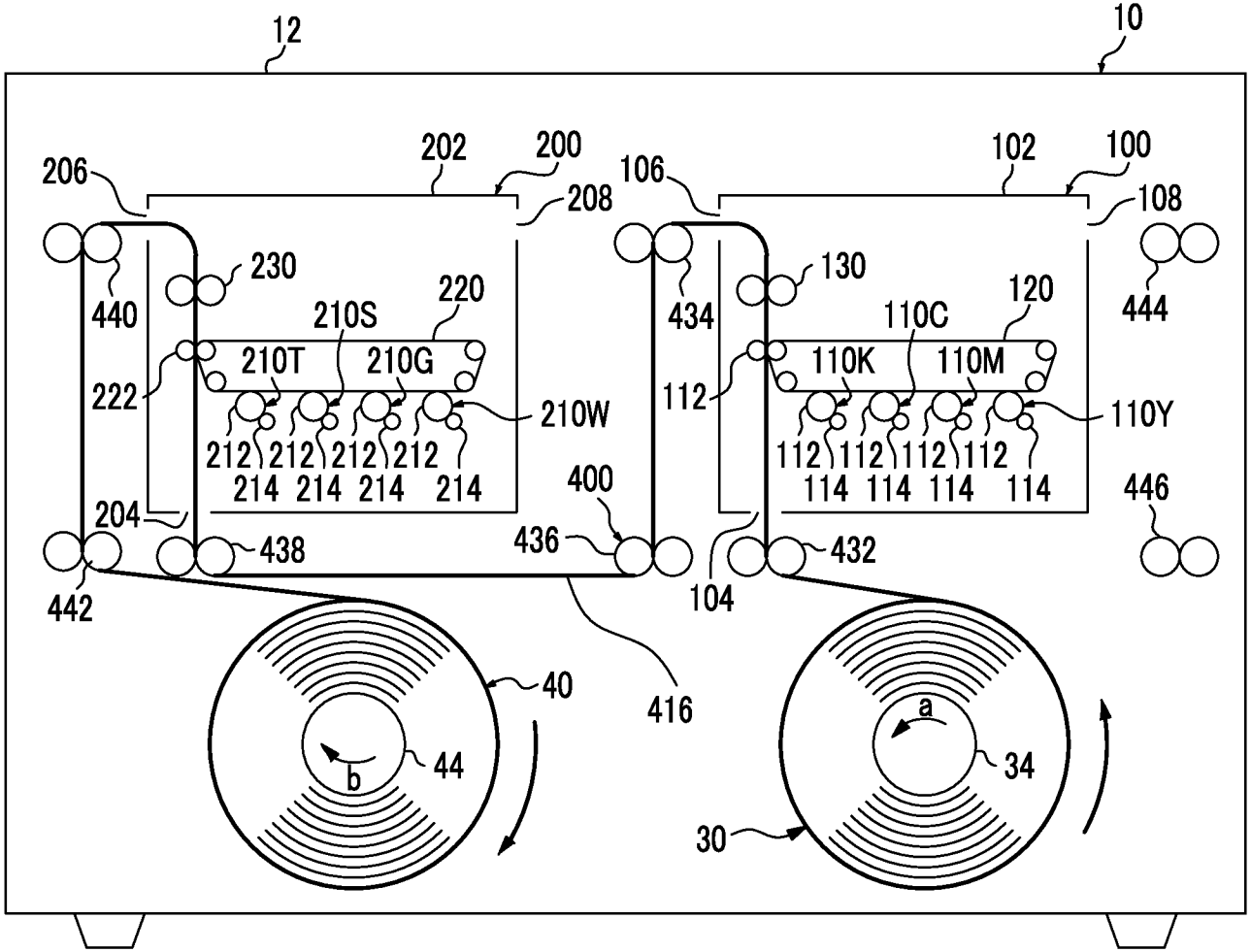
FIG. 14 is a diagram showing a state where the recording medium is rewound by the second unwinding and rewinding device so that the surface of the recording medium side, on which the image is formed, is toward the inner side, in the image forming apparatus shown in FIG. 1.

FIG. 14 shows a state where the sheet is rewound by the second unwinding and rewinding device 40 so that the surface of the sheet side, on which the image is formed, is toward the inner side, in the image forming apparatus 10 according to the first exemplary embodiment. In the above descriptions, although any transport path is used, when the second unwinding and rewinding device 40 is used as the rewinder, the example, in which the second unwinding and rewinding device 40 rewinds the sheet so that the surface of the sheet on which the image is formed is toward the outer side, is described (refer to FIGS. 2, 3, and 4). However, as shown in FIG. 14, in the image forming apparatus 10 according to the first exemplary embodiment, the second unwinding and rewinding device 40 may rewind the sheet to be wound so that the surface of the sheet side, on which the image is formed, is toward the inner side. In this case, the rotating shaft 44 is controlled to be rotated in the arrow b direction.

As described above, in the image forming apparatus 10 according to the first exemplary embodiment, for example, according to whether the sheet is wound so that the surface of the side selected when the image forming of the sheet is performed becomes the front side, whether the sheet is wound so that the surface of the side selected when the image forming of the sheet is performed becomes the rear side, or the like, whether the image is formed on the front surface of the wound sheet or whether the image is formed on the rear surface of the wound sheet may be selected. Moreover, as described above, in the image forming apparatus 10 according to the first exemplary embodiment, according to circumstances of post processing such as the sheet having the formed image being separated to be plural sheets or the sheet having the formed image is drawn out, whether the sheet is rewound so that the surface of the side on which the image is formed is toward the outer side or whether the sheet is rewound so that the surface of the side on which the image is formed is toward the inner side may be selected.

Similar to the descriptions in the image forming apparatus 10 according to the first exemplary embodiment, in the image forming apparatus 10 according to the second exemplary embodiment, the sheet may be supplied from the first unwinding and rewinding device 30 so that the image is formed on the rear surface of the wound sheet, the sheet may be rewound by the first unwinding and rewinding device 30 so that the surface of the sheet side on which the image is formed is toward the inner side, the sheet may be supplied from the second unwinding and rewinding device 40 so that the image is formed on the rear surface of the wound sheet, and the sheet may be rewound by the second unwinding and rewinding device 40 so that the surface of the sheet side on which the image is formed is toward the inner side.

In addition, in each exemplary embodiment described above, the example in which the plural image forming portions include two image forming portions such as the first image forming portion 100 and the second image forming portion 200 is described. However, the present invention may also be applied to an apparatus including three or more image forming portions such as three image forming portions.

Moreover, in each exemplary embodiment described above, the case where the first image forming portion 100 includes four toner image forming portions used as the single color image forming portions such as the toner image forming portion 110Y, the toner image forming portion 110M, the toner image forming portion 110C, and the toner image forming portion 110K, and the second image forming portion 200 includes the toner image forming portions used as four single color image forming portions such as the toner image forming portion 210W, the toner image forming portion 210G, the toner image forming portion 210S, and the toner image forming portion 210T is described as an example. However, the number of the single color image forming portions included in each image forming portion is not necessarily four, and the number of the single color image forming portions included in each image forming portion may be appropriately determined.

As described above, for example, the present invention may be applied to at least an image forming apparatus such as a printer, a fax machine, a copier, or a printing machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image forming portions configured to form an image on a recording medium; and a transport unit configured to transport the recording medium to at least one image forming portion selected among the plurality of image forming portions, wherein the transport unit includes a plurality of transport paths configured to be different in an image forming portion, to which the recording medium is transported, among the plurality of image forming portions, and in an order in which the recording medium transported to each image forming portion constituting the image forming portion to which the recording medium is transported.

2. The image forming apparatus according to claim 1, further comprising:

an unwinder configured to supply the recording medium; and a rewinder configured to rewind the recording medium on which the image is formed, wherein a function or a position of the unwinder and a function or a position of the rewinder are exchangeable with each other, and wherein the transport unit switches a transport direction of the recording medium so that the recording medium is transported from the unwinder to the rewinder.

3. The image forming apparatus according to claim 2, wherein at least one of the plurality of image forming portions includes a plurality of single color image forming portions that form a single color image.

4. The image forming apparatus according to claim 2, wherein the unwinder is disposed below one or more of the image forming portions constituting the plurality of image forming portions in the direction of gravity.

5. The image forming apparatus according to claim 4, wherein the rewinder is disposed below one or more of the image forming portions constituting the plurality of image forming portions in the direction of gravity.

6. The image forming apparatus according to claim 2, wherein the rewinder is disposed below one or more of the image forming portions constituting the plurality of image forming portions in the direction of gravity.

7. The image forming apparatus according to claim 2, wherein the recording medium continuing in a longitudinal direction is used, and wherein the transport unit transports the recording medium in the longitudinal direction of the recording medium.

8. The image forming apparatus according to claim 7, wherein the unwinder supplies a wound recording medium continuing in the longitudinal direction, and is switchable whether to supply the recording medium so that the image is formed on a first surface of the wound recording medium or to supply the recording medium so that the image is formed on a second surface of the wound recording medium.

9. The image forming apparatus according to claim 7, further comprising:

a first discharge hole that is used to discharge the recording medium at the first transport path, and a second discharge hole that is used to discharge the recording medium at the second transport path and is formed at different place from the first discharge hole.

10. The image forming apparatus according to claim 1, wherein at least one of the plurality of image forming portions includes a plurality of single color image forming portions that form a single color image.

11. The image forming apparatus according to claim 10, wherein the unwinder is disposed below one or more of the image forming portions constituting the plurality of image forming portions in the direction of gravity.

12. The image forming apparatus according to claim 10, wherein the rewinder is disposed below one or more of the image forming portions constituting the plurality of image forming portions in the direction of gravity.

13. The image forming apparatus according to claim 1, wherein the recording medium continuing in a longitudinal direction is used, and wherein the transport unit transports the recording medium in the longitudinal direction of the recording medium.

14. The image forming apparatus according to claim 13, wherein the unwinder supplies a wound recording medium continuing in the longitudinal direction, and is switchable whether to supply the recording medium so that the image is formed on a first surface of the wound recording medium or to supply the recording medium so that the image is formed on a second surface of the wound recording medium.

15. The image forming apparatus according to claim 14, wherein the rewinder rewinds to wind the recording medium continuing in the longitudinal direction, and is switchable whether to wind the recording medium so that a surface of the recording medium side on which the image is formed is toward an outer side or to wind the recording medium so that a surface of the recording medium side on which the image is formed is toward an inner side.

16. The image forming apparatus according to claim 13, wherein the rewinder rewinds to wind the recording medium continuing in the longitudinal direction, and is switchable whether to wind the recording medium so that a surface of the recording medium side on which the image is formed is toward an outer side or to wind the recording medium so that a surface of the recording medium side on which the image is formed is toward an inner side.

17. An image forming apparatus comprising:

a first image forming portion that forms a first image on a recording medium;

a second image forming portion that forms a second image on the recording medium;

a first transport path through which the recording medium is transported to a first image forming portion and is not transported to the second image forming portion;

a second transport path through which the recording medium is transported to the second image forming portion after being transported to the first image forming portion; and a third transport path through which the recording medium is transported to the first image forming portion after being transported to the second image forming portion.

18. An image forming apparatus comprising:

a first image forming portion that forms a first image on a recording medium;

a second image forming portion that forms a second image on the recording medium;

a first transport path through which the recording medium is transported to the second image forming portion after being transported to the first image forming portion; and a second transport path through which the recording medium is transported to the first image forming portion after being transported to the second image forming portion, wherein the first image forming portion includes an insertion hole that is used to insert the recording medium at the first transport path and the second transport path.

* * * * *